United States Patent [19]

Deaton

[11] 4,021,985

[45] May 10, 1977

[54] ILLUMINATOR GRIDS AND METHOD OF FORMING BAFFLES THEREFOR

[76] Inventor: Charles U. Deaton, Genessee Mountain, Golden, Colo. 80401

[22] Filed: Dec. 8, 1975

[21] Appl. No.: 638,617

[52] U.S. Cl. ..... 52/473; 52/507; 52/662; 52/675

[51] Int. Cl.[2] ..... E06B 7/08

[58] Field of Search ..... 52/78, 28, 507, 473, 52/675, 662, 670, 671, 675; 98/88 L, 121 R, 99.8, 114; 350/276 R

[56] References Cited

UNITED STATES PATENTS

| | | | |
|---|---|---|---|
| 157,463 | 12/1874 | Steele | 52/473 |
| 477,545 | 6/1892 | Howell | 98/121 R |
| 582,016 | 5/1897 | Hegbom | 52/675 |
| 634,237 | 10/1899 | Fugman | 52/675 |
| 749,116 | 1/1904 | Valentine | 52/473 |
| 2,007,716 | 7/1935 | Green | 52/473 |
| 2,126,525 | 8/1938 | Anderson | 98/121 R |
| 2,366,224 | 1/1945 | Warp | 98/121 R |
| 2,430,518 | 11/1947 | Mainwal | 52/675 |

FOREIGN PATENTS OR APPLICATIONS

| | | | |
|---|---|---|---|
| 1,038,151 | 9/1953 | France | 52/473 |
| 2,038,895 | 7/1972 | Germany | 52/662 |
| 323,263 | 9/1957 | Switzerland | 98/121 R |
| 674,454 | 6/1952 | United Kingdom | 52/473 |

*Primary Examiner*—Price C. Faw, Jr.
*Assistant Examiner*—Henry Raduazo
*Attorney, Agent, or Firm*—Horace B. Van Valkenburgh; Frank C. Lowe

[57] ABSTRACT

A series of upright, longitudinally extending baffles are supported in parallel array, with the transverse or secondary baffles being formed by twisting out of the webs of the primary baffles an area initially separated by slots which leave a stem connecting the secondary baffle with the web at two opposed positions, normally the top and bottom. When the secondary baffle is twisted, each of the webs is twisted, as to 90°, to support the secondary baffle transversely to the primary baffles. Normally, the secondary baffles extend the same distance to each side of the corresponding primary baffle. The secondary baffles of one primary baffle are normally interspaced with the secondary baffles of the adjacent primary baffles. Upright ribs and upper and lower edges formed as offset flanges may be utilized to strengthen the primary baffles, while a tubular strip may engage the lower angular flange, so that a spring pressed pin may extend from the reinforcing tube of one baffle into the reinforcing tube of the next baffle in line. The longitudinal baffles may be connected to supporting rails by a specially formed slot in a depending rib of the supporting rail and cooperating notches in the upper corner of the corresponding longitudinal baffle.

17 Claims, 23 Drawing Figures

ILLUMINATOR GRIDS AND METHOD OF FORMING BAFFLES THEREFOR

This invention relates to overhead illuminator grids for masking the glare of an illuminator, such as an assembly of light tubes or lamps, from direct view, and a method of forming the baffles thereof.

For some time, a popular type of illuminator grid has been the "egg crate" type, which is an array of longitudinal and transverse interlocking strips or baffles. Since each grid may be required to cover a substantial area, the grid must be in sections or panels, to permit access to the lighting system above a portion of the grid, since it would be impractical to remove or hinge downwardly the entire grid every time a light tube must be replaced. Another disadvantage of an egg crate type of illuminator grid resides in the tendency for a panel of these grids to rack diagonally, especially when the panels are not held in frames. A further disadvantage of the egg crate type of illuminator grids is the weight of the baffles which makes a larger convenient size of baffle assembly to have an undue weight.

In accordance with the present invention, an illuminator grid is composed of a series of primary baffles extending longitudinally,but removably connected at each end to a supporting rail. Each primary baffle is provided with a plurality of integral secondary baffles which are angular, such as perpendicular, to the respective primary baffle and extend to each side thereof. The primary baffle of this invention may include a large number of secondary baffles which may be alternated in longitudinal position on adjacent primary baffles, so as to intercept light rays from the tubes, which light rays are 45° to the horizontal or less, the customary interception pattern. A further feature of this invention is that the secondary baffles are formed from the primary baffles, leaving cutouts which do not essentially interfere with the light shielding capacity of the primary baffles. Such cutouts clearly reduce the weight of the baffle assembly and also do not involve the problem of interfitting longitudinal and transverse baffles, as in the egg crate style.

The method of this invention, for making a secondary baffle, includes forming a slot in a primary baffle, which slot circumscribes an area corresponding to the desired secondary baffle, except for stems which connect, at opposed positions, the embryo secondary baffle with the primary baffle. These stems are normally placed centrally of the secondary baffle, at the top and bottom. The secondary baffle is then rotated or twisted, normally through an angle of 90°, so that both stems will twist and the secondary baffle will be positioned at such angle to the primary baffle and normally will extend to each side of the primary baffle. A series of secondary baffles may be spaced apart equal distances in a row, or more than one row of secondary baffles may be produced.

Additional features of this invention will become apparent from the following description, taken in conjunction with the accompanying drawings, in which.

Figure 1:
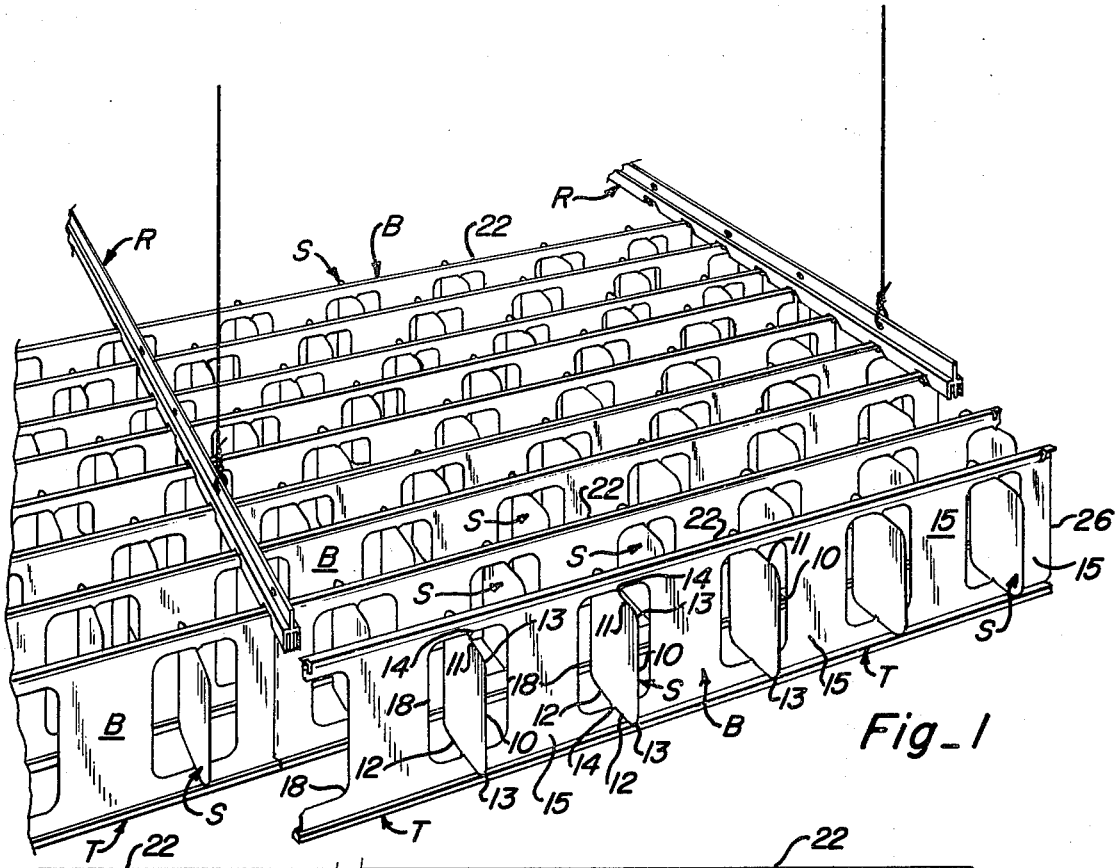
FIG. 1 is a fragmentary perspective view, looking obliquely downwardly onto an illuminator grid which includes baffles constructed in accordance with this invention.
Figure 2:
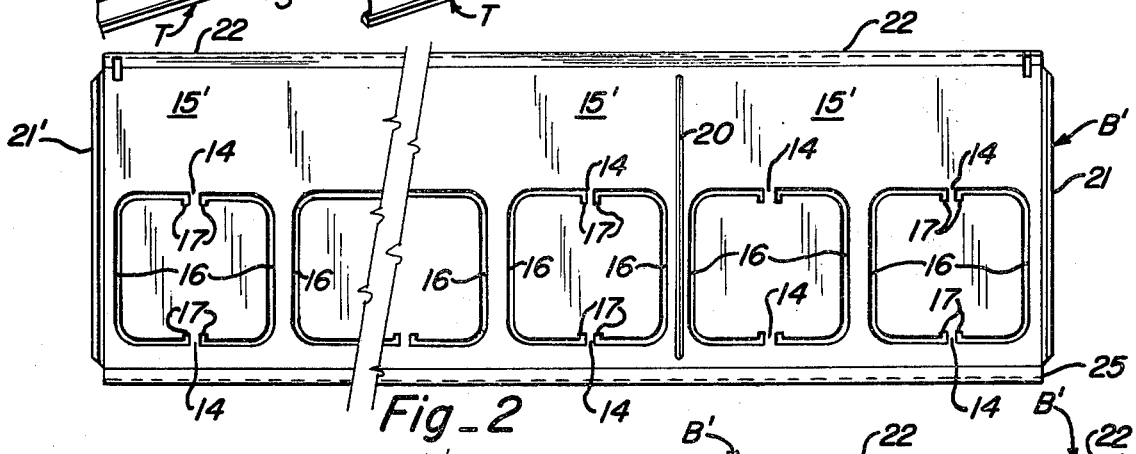
FIG. 2 is a condensed side elevation, on an enlarged scale, of a modified baffle shown in one stage of manufacture, i.e. after a series of slots have been produced.

A baffle assembly contructed in accordance with this invention, as illustrated in FIG. 1, may comprise a series of primary baffles B, from which a series of auxiliary or secondary baffles S extend laterally and normally to each side. Each primary baffle B is supported between a spaced pair of rails R, a suitable connection between the two being described later. Each auxiliary or secondary baffle S may be provided, on each side, with a side edge 10, a top edge 11 and a bottom edge 12 with rounded corners 13. At the center of both its top and bottom, each secondary baffle S is attached to the primary baffle by a twisted stem 14, which is formed in a manner described below. The secondary baffles are formed from a web 15 of the primary baffle B which is provided with a reinforcing strip T at the bottom. The baffles B of FIG. 1 and the baffle B′ of FIG. 2 are similar in construction, except that the web 15′ of the baffle B′ of FIG. 2 has a greater height than the web 15 of the baffle B of FIG. 1. The height of the primary baffles is generally a matter of choice, depending upon whether a greater or lesser amount of shielding is to be accomplished.

To permit turning the secondary baffles S into an angular position, normally perpendicular to the web 15 or 15′ of the primary baffle, a series of opposed pairs of slots 16 are stamped in the web, as in FIG. 2, with the inner edge of each slot 16 conforming to the sides, top, bottom and rounded corners of one side of the secondary baffle S. Thus, each slot 16 corresponds to one half of a rectangle with rounded outer corners. Preferably, the distance between the side edges of opposed slots 16 approximates the distance between the top and bottom edges thereof. At the center of the opposed slots 16, a short, perpendicular slot 17 at the end of each slot 16 extends downwardly at the top and upwardly at the bottom, leaving a stem 14 between each opposed pair of slots 17. When the portions of the web 15′ outlined by slots 16 are rotated about the center of each stem 14 as an axis, each stem 14 will be twisted to a 90° spiral, as in FIG. 3, thereby retaining the secondary baffles in a fixed 90° positions, while the secondary baffles also extend for an equal distance to each side. Such extension at each side for an equal distance is not always necessary, since for esthetic purposes, and in order to achieve a design which is possibly more pleasing to the eye, the width of the secondary baffles, on opposite sides of the primary baffle, may be varied. Of course, it is again necessary to provide a sufficient height for the primary baffles to intercept light from the fluorescent tubes, for instance, to the desired extent. When the baffles S are twisted to a position perpendicular to the web of the primary baffle, a cutout 18, as in FIGS. 1 and 3, appears at each side of each secondary baffle. In the arrangement of FIG. 1, it is noted that the secondary baffles S alternate between the secondary baffles of the next primary baffle, so that each cutout 18 is opposite a solid portion of the web of the adjoining primary baffle. However, in the baffle of FIGS. 2 and 3, the secondary baffles are more closely spaced together than in FIG. 1, but they occupy less of the height of the primarybaffle, so that, again, a desired light interception is obtained.

Figure 3:
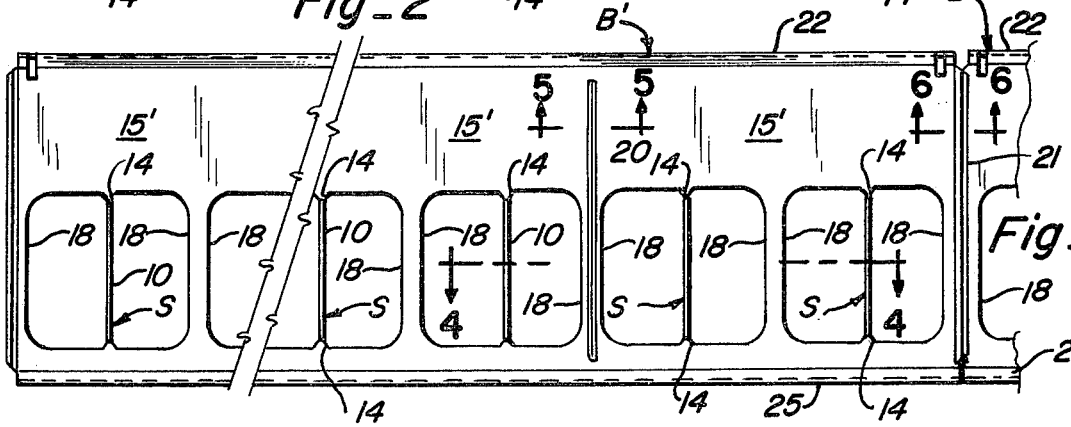
FIG. 3 is a condensed side elevation of the baffle of FIG. 2 but shown at a later stage of manufacture, i.e. after the baffle sections outlined by the slots have been turned to perpendicular positions, and also showing a portion of the next baffle.
Figure 4:
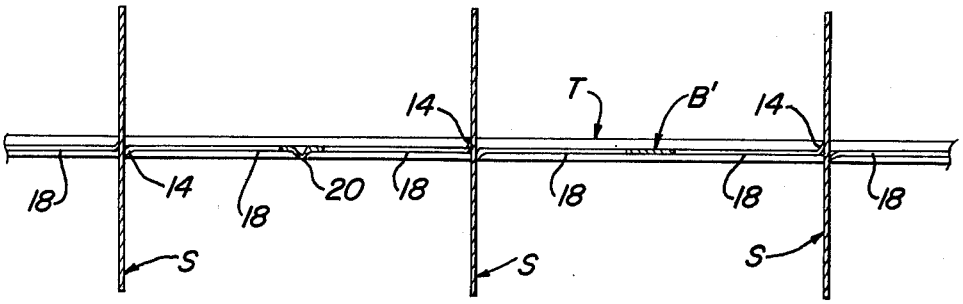
FIG. 4 is a limited horizontal section, on an enlarged scale, taken along line 4—4 of FIG. 3.
Figure 5:
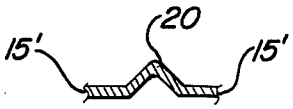
FIG. 5 is a fragmentary horizontal section, on a further enlarged scale, taken along line 5—5 of FIG. 3 and showing particularly a reinforcing rib.
Figure 6:
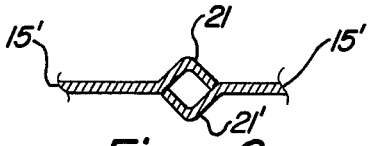
FIG. 6 is a fragmentary horizontal section, on a scale corresponding to FIG. 5, taken along line 6—6 of FIG. 3 and showing particularly the overlap of the ends of adjoining baffles.
Figure 10:
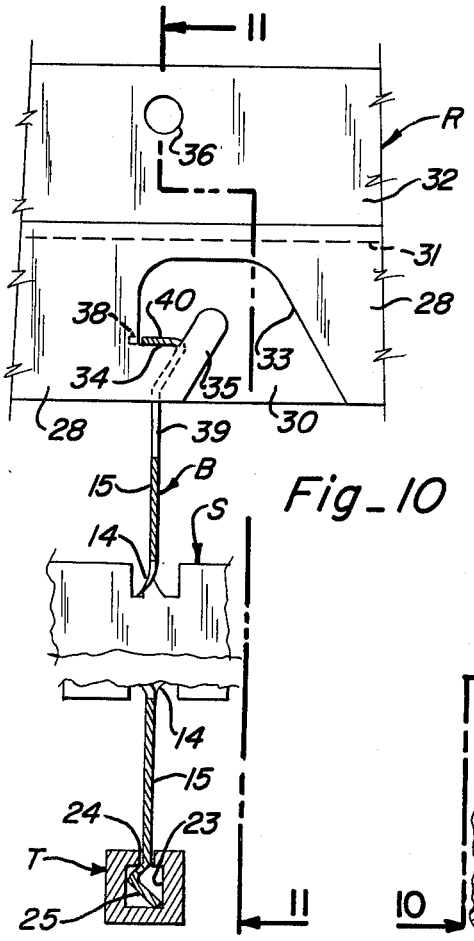
FIG. 10 is a side elevation, on an enlarged scale, ofa portion of the supporting rail of FIG. 9 and an offset, condensed vertical section of a baffle supported by it, taken along line 10—10 of FIG. 11.

The primary baffle of FIGS. 2 and 3 is provided with one or more stamped, upright reinforcing ribs 20, shown also in FIGS. 4 and 5, which permit the primary baffle to be formed of thinner material. Also, the primary baffles are provided at each end with an angular, upright tongue 21 at one side and an angular, upright tongue 21′ at the opposite side, the adjacent tongues being on opposite sides of the longitudinal centerline of the baffles, so that they not only reinforce the respective primary baffle, but also overlap, as in FIG. 6, to add additional rigidity to the baffle assembly. The secondary baffles are conveniently placed at equal intervals along the primary baffle, as in FIGS. 3 and 4. The baffles B or B′ are also provided with an angular top edge 22 which not only reinforces the baffle, to minimize lateral flexure, but also forms part of the connections for attachment to and detachment from the rails R. The reinforcing tube T, as in FIG. 10, is rectangular in cross section and also has a rectangular hollow 23 on the inside, being provided with a longitudinal slot 24 leading to the hollow 23. The slot 24 accommodates, with an appropriate clearance, the thickness of the primary baffle for reception of an angular lower edge 25 of the primary baffle within the tube. As will be evident, the shape of the angular lower edge 25 is such as to engage opposite sides of hollow 23 and prevent twisting of the tube T, thus adding to the rigidity of the structure.

Figure 7:
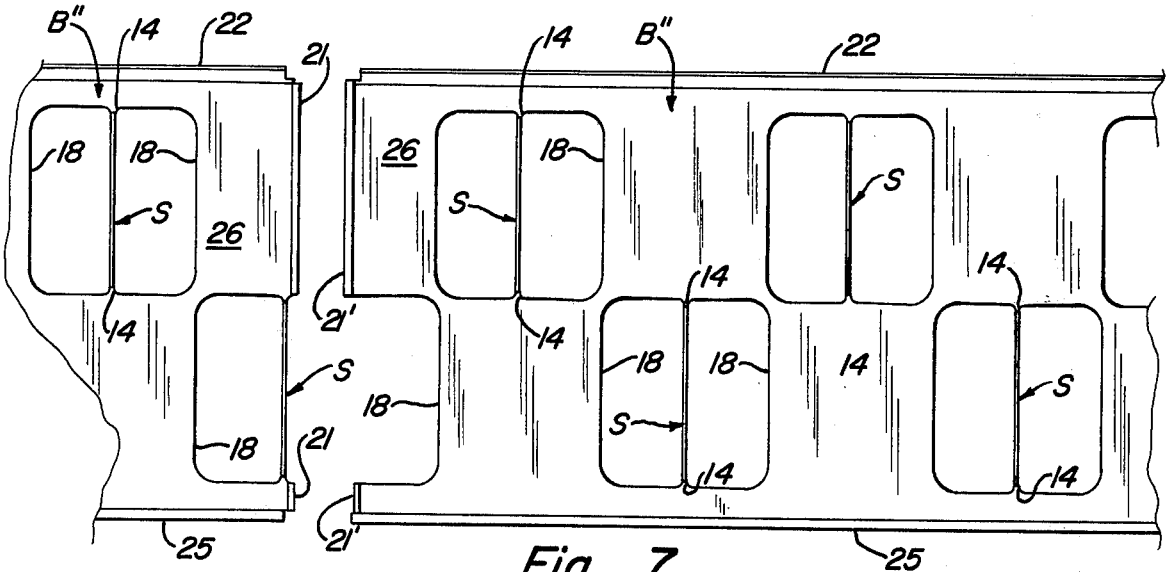
FIG. 7 is a fragmentary side elevation corresponding to FIG. 3 but showing a different pattern of secondary baffles.
Figure 15:
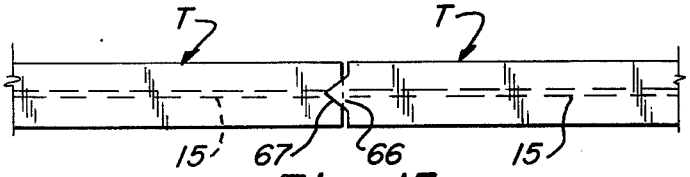
FIG. 15 is a bottom plan view, looking upwardly, of an alternative joint arrangement between abutting tubular reinforcements.

In the alternative construction illustrated in FIG. 7, the web 15″ of the primary baffle B″ is substantially higher than the web 15 of FIG. 1 or 15′ of FIG. 2, while the secondary baffles S are placed in two horizontal rows, but in staggered relation longitudinally of the primary baffle. The secondary baffles of FIG. 7 are produced in the same way, i.e. by forming slots corresponding to slots 16 of FIG. 2, each with an inner extension at both the top and bottom and connecting to inner extensions 17. Then, the secondary baffles are twisted through 90°, so that each secondary baffle will remain connected to the web of the primary baffle by a twisted stem 14 at both the top and the bottom, while leaving a cutout 18 on each side, as before. In each of FIGS. 1 and 8, it will be noted that the secondary baffles S are disposed in staggered relation to the secondary baffles of the next adjacent primary baffle. This is producible by a cutout 18 at one end of the primary baffle and a cutout 18, together with a secondary baffle, at the other end of the primary baffle. In FIG. 7, the upper row of baffles terminates in a solid section 26 at the edge of each primary baffle B″, while the lower row terminates respectively in a cutout 18 and a cutout 118 with a secondary baffle S at one edge.

Figure 8:
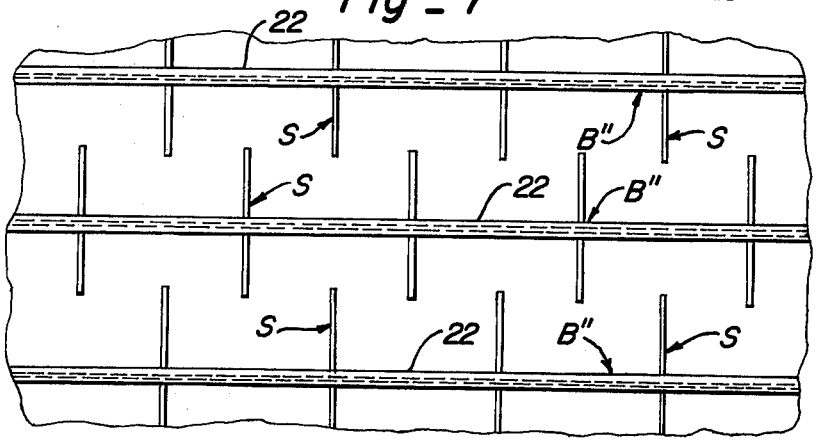
FIG. 8 is a top plan view of a series of baffles of FIG. 7, in the relative position of installation.
Figure 9:
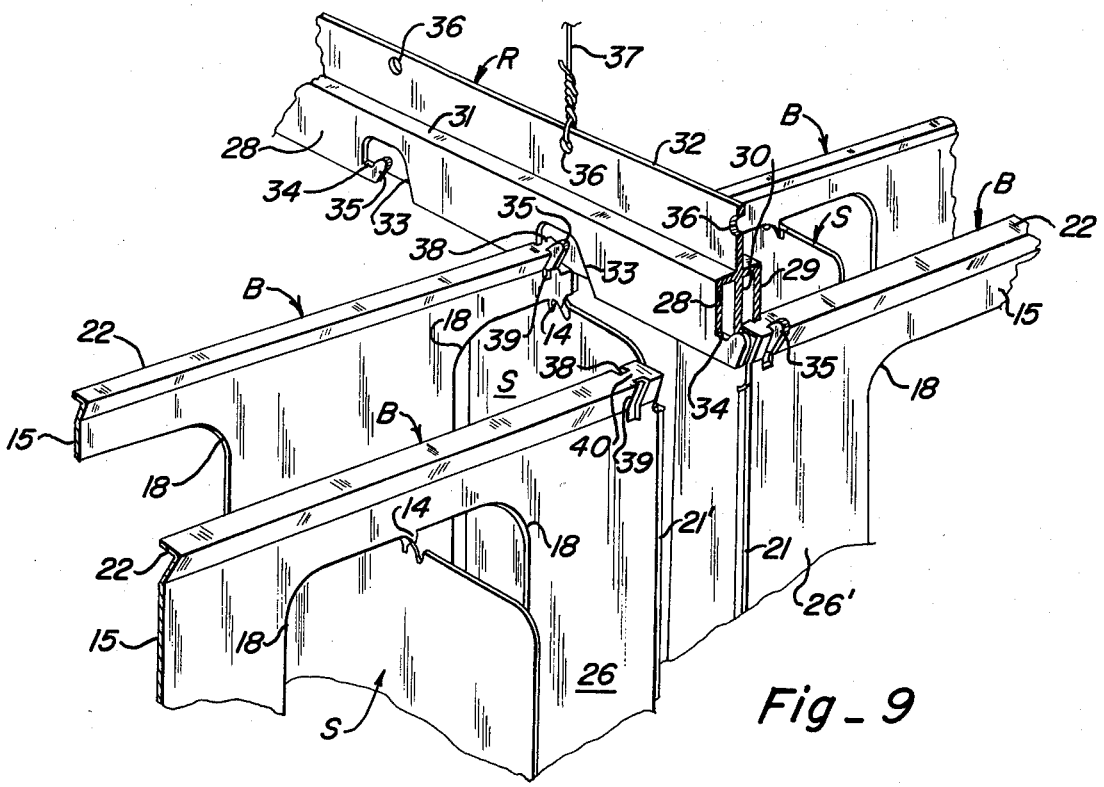
FIG. 9 is an oblique, fragmentary perspective view of a portion of a baffle support rail and several baffles supported thereby, with the support rail in section and one baffle spaced endwise from the rail for clarity of illustration.
Figure 11:
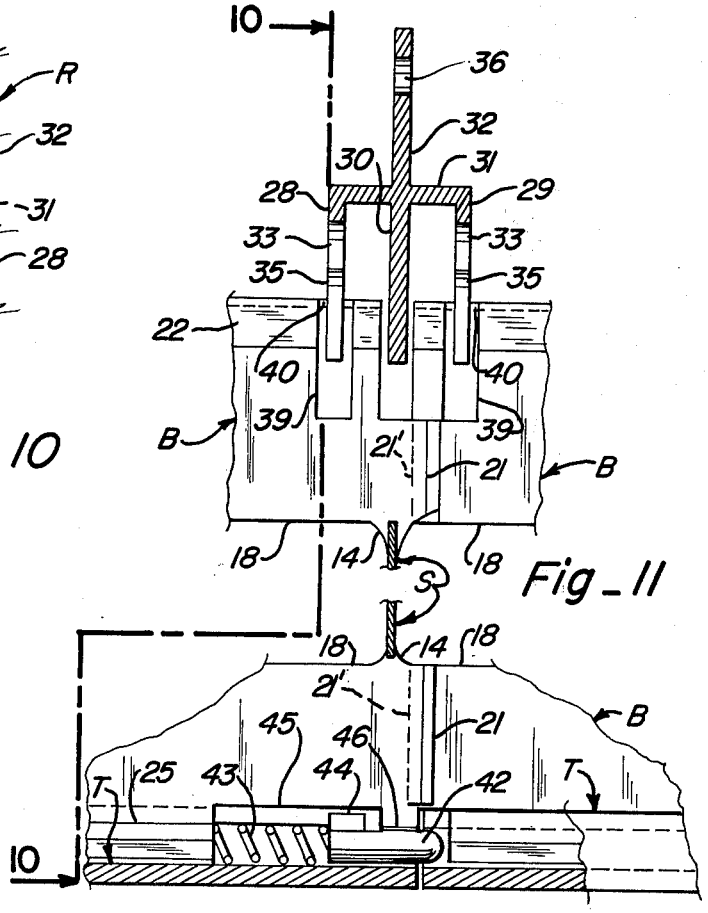
FIG. 11 is an offset, condensed vertical section taken along line 11—11 of FIG. 10.

The attachment of baffles B to one of the supporting rails R is illustrated in FIGS. 9–11, it being understood that the opposite ends of the baffles shown will normally be attached to the corresponding rail R in the same manner and that the baffles B′ of FIGS. 2–6 and baffles B″ of FIGS. 7 and 8 may be attached to similar rails R in a similar manner. Each rail R may include a pair of depending outer ribs 28 and 29 disposed on opposite sides of a depending center rib 30, with the ribs extending downwardly in spaced relation from a transverse bar 31, which, in turn, is connected to an upper rib 32. These parts of rail R may be formed integrally, as by extrusion. As shown, at the position of each bAffle B, each rib 28 and 29 of rail R is provided with a slot 33, the edge of which angles upwardly, then across and then downwardly to a flat 34 which abuts an inclined thumb 35, which extends away from the flat but with an upward inclination. Each rail rib 32 is provided with a series of spaced holes 36, to a selected number of which a support wire 37 may be attached. Each of the baffles B is provided with a notch 38 in the top of angle 22 and an opposed notch 39 which extends downwardly into web 15, the slots 38 and 39 leaving between them a neck 40 which is proportioned to fit against flat 34, with thumb 35 extending through slot 39, as in FIG. 10, and slot 38 engaging the outer rib 28 or 29 adjacent flat 34. This connection will permit the baffle B to depend from the rail R in a relatively stable position, since a combination of both upward movement and lateral movement of the baffle B will be necessary to move neck 40 upwardly and over thumb 35. However, the baffles are readily mounted on the rails by inserting the top 22 of baffle B within a rail slot 33, with the baffle notches 38 and 39 in alignment with thumb 35, and then move the neck 40 over the top of thumb 35 and into engagement with the flat 34. The opposite ends of a baffle B may be attached in succession to two of the rails R in a similar manner until all of the baffles are hung on the rails. It will be noted that the thumb 35 faces in the direction of the apex of angle 22 at the top of each baffle B. This provision is desirable in order to utilize the notches 38, 39 and neck 40 as shown. It will be understood, of course, that other connections for suspending the baffles B from the rails R may be utilized. As in FIG. 9, the ends of the baffles B shown are provided with the overlapping angles 21 and 21'.

Figure 12:
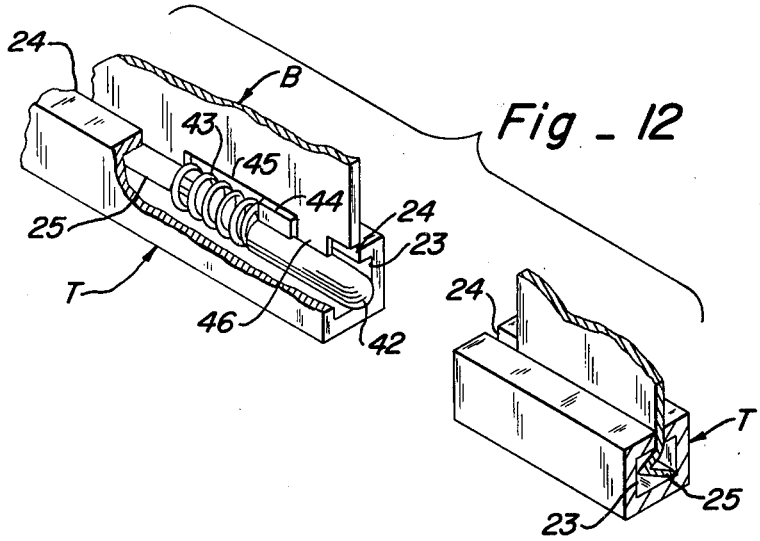
FIG. 12 is a fragmentary perspective view, illustrating a spring pressed pin and a reinforcing strip engaged by the lower edges of adjacent panels, on a larger scale than FIG. 11 in which they are also shown.

In order to provide additional rigidity for the baffles B, a pin 42 is placed within one end of the rectangular tubular reinforcing strip T in which the lower angle 25 of the primary baffle is disposed, as in FIGS. 11 and 12, while the pin 42 is urged longitudinally of the strip by a spring 43. As shown in FIG. 12, a guide rail 44 of pin 42 engages the upper slot 24 in the tubular reinforcing strip T, while a notch 45 in the baffle B accommodates longitudinal movement of the guide rail 44. Also, a depending abutment 46 restrains movement of guide rail 44 beyond a predetermined point. The angle 22 at the bottom of the baffle is, of course, omitted over the area occupied by pin 42 and spring 43. The pin 42, when temporarily pushed inwardly, will snap into the rectangular hole in tube T of the next baffle, as in FIG. 11, to hold the abutting ends of the adjacent baffles B against relative lateral movement, thus steadying the assembly and reinforcing the baffles against accidental movement, due to air currents or the like.

Figure 13:
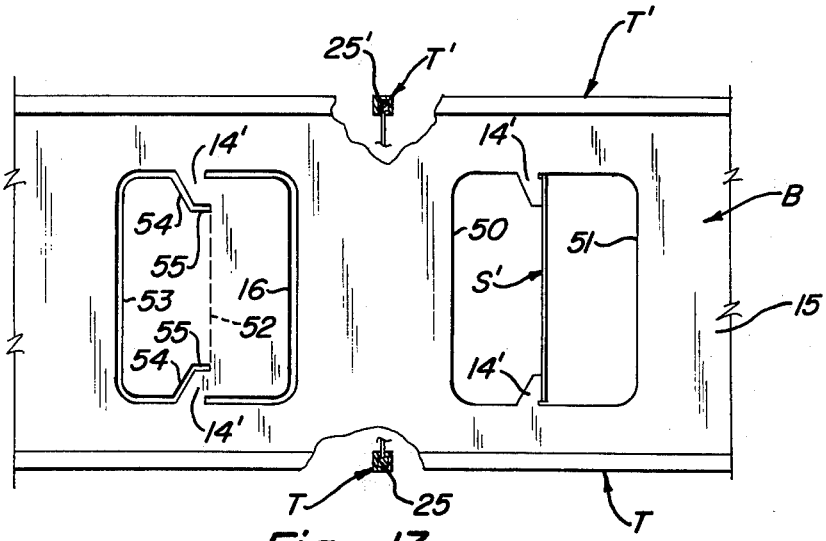
FIG. 13 is a side elevation of an alternative baffle construction of this invention, showing slots for one secondary baffle prior to turning and another baffle section turned to a perpendicular position, with cross sectional insets of the upper and lower edges of the primary baffle.

In the alternative construction illustrated in FIG. 13, each baffle B is provided with a series of secondary baffles S' turned to the perpendicular position shown at the right, to leave cutouts 50 and 51. The upper and lower edges of a baffle S' is connected to the web 15 of the corresponding baffle B by a stem 14' which is bent to 90°, rather than being twisted to 90°, along an axis indicated by dotted line 52 at the left of FIG. 13. Preparatory to turning the secondary baffles S' into position, a slot 16 similar to slot 16 of FIG. 2, but without the stem slot 17, is provided at one side of the axis 52, as at the left. On the opposite side is formed a slot, a portion of which is shaped similar to a part of slot 16 connected both above and below with an angular slot 54 extending toward the axis from each of the ends of slot 53, and a slot 55 which extends laterally from the inner end of each slot 54 toward and slightly past the centerline 52. The inner ends of slot 16 and the inner ends of slots 55 may overlap for a distance corresponding to or even slightly greater than the thickness of the material of which the baffle B is made. As will be evident, the shape of the baffle S' will correspond to the inside contour of slots 16 and 53, 54 and 55. The rounded corners, as shown, may be utilized as before, while the pivot axis of the formation of the baffle S' may be placed centrally between the upright portions of the cutouts 50 and 51.

Baffle B of the embodiment shown in FIG. 13 may further be provided with an angular lower edge 25 engaging the inside of a tubular reinforcing strip T, in a manner similar to that shown in FIG. 10, while a similar angular tongue 25' at the upper edge may fit within a similar tubular reinforcing strip T'. However, if this baffle is to be attached to a supporting rail in a manner similar to that illustrated in FIGS. 9–11, the tongue 25° should be merged, at a point spaced from the end of the baffle, with an angle 22, with appropriate attachment notches therein. As will be evident, the top angle 25' may, if desired, be discontinued at a point spaced from the end of the reinforcing tube T' and the latter formed with slots corresponding to slots 38 and 39 of FIG. 10, leaving the neck corresponding to neck 40 as one half of the top of the tube T.

Figure 14:
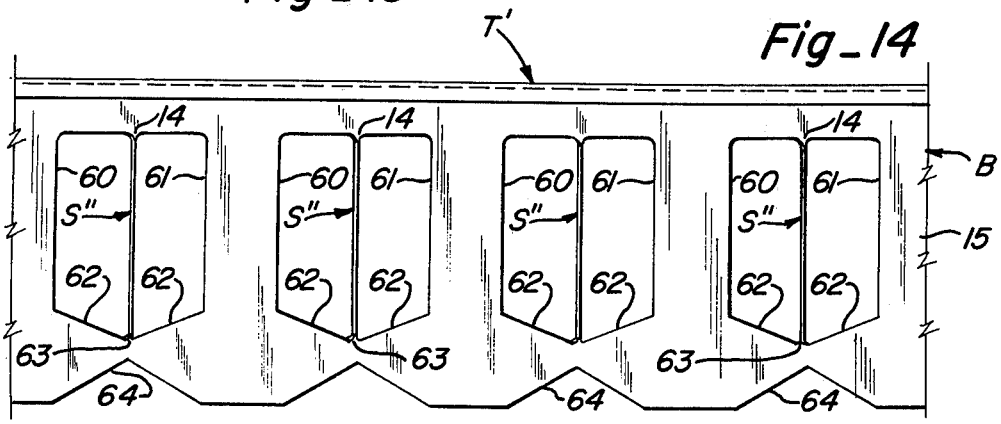
FIG. 14 is a fragmentary side elevation of a further alternative baffle.

In the alternative construction illustrated in FIG.14, secondary baffles S'' may be turned 90° to the web 15 of baffle B, being separated from the web by slots producing a cutout on opposite sides of the baffle having a side and upper edge 60 and 61, respectively, which correspond to the respective side and upper edge of the cutout 18 of FIG. 3. The lower edge 62 of each side of the cutout slants inwardly and downwardly to produce an essentially pentagonal secondary baffle. The latter is connected to web 15 at the top by twisted stem 14, as before, but at the bottom by a twisted stem 63 at the apex of the lower edges 62. The baffle may be provided with a tubular member T' at the top, as before, but with a series of notches 64 in the lower edge of the web and placed opposite the secondary baffles S''. A notch 64 may form a dihedral angle corresponding to cutout edges 62 but in a reverse direction.

In the alternative construction illustrated in FIG. 15, a bottom tubular reinforcing member T has at one end a tongue 66 and at the opposite end a corresponding notch 67, so that abutting baffles may be restrained against lateral separation at the abutting ends by a tongue 66 of one baffle fitting into a notch 67 of the next baffle, as shown.

Figure 16:
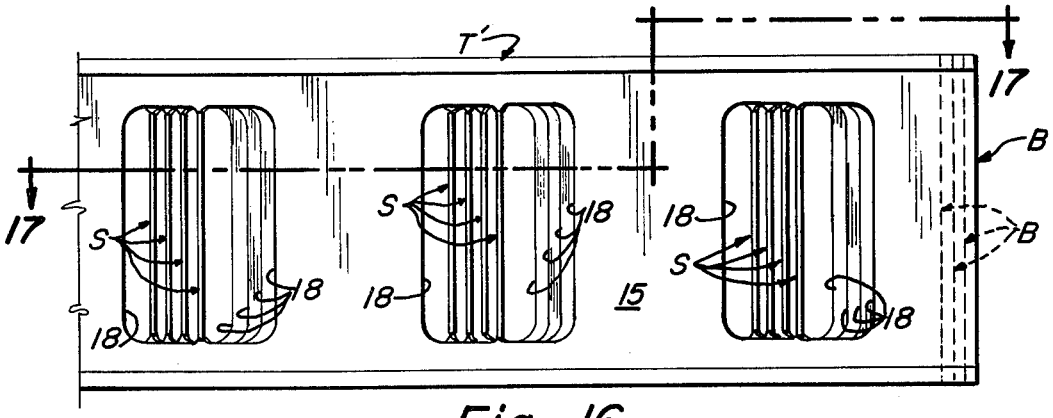
FIG. 16 is a side elevation of a series of baffles of this invention in stacked relation, as for shipping or storage.
Figure 17:
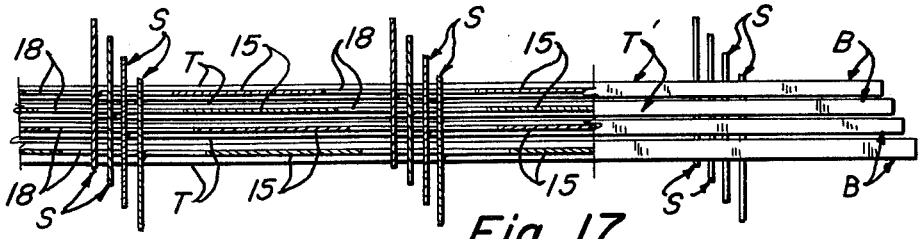
FIG. 17 is an offset section taken along line 17—17 of FIG. 16.

Since the secondary baffles, such as baffles S, are fixed in position, when turned to twist or bend the connecting stems, they would thus impliedly require a separate space for storage or shipment, corresponding to the length and height of the primary baffle and the transverse dimension of the secondary baffles. However, it is possible to stack the completed baffles laterally to decrease considerably the space required for storage of an individual baffle. This is accomplished, as in FIGS. 16 and 17, by placing in parallel a series of baffles, with the ends spaced slightly apart, and inserting the baffles S into the cutouts 18 of the adjacent baffles. As will be evident, the height of baffles B is less than the height of the cutouts 18 by the width of slot 16 above and slot 16 below, as in FIG. 2, so that the intersecting secondary baffles will avoid contact with any edge of a cutout through which it extends. Although four baffles B are shown in stacked relation, it will be understood that more or less than four may be placed in a laterally stacked relation. As will be evident, the secondary baffles are spaced apart a minimum of the longitudinal distance corresponding to the width of stem 14 on one side. As many baffles as can be handled conveniently may be laterally stacked in this fashion, thus reducing the volume necessary for storage or shipment of the baffles.

Figure 18:
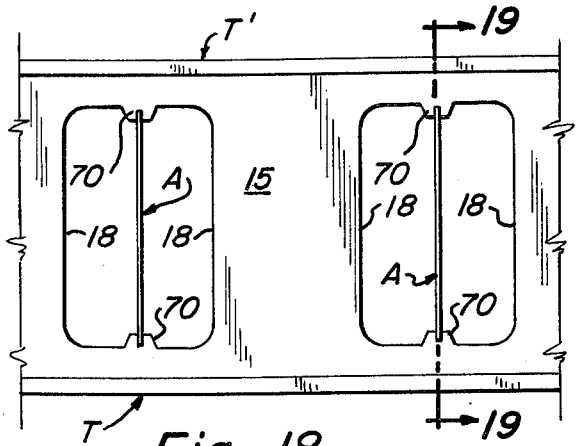
FIG. 18 is a fragmentary side elevation of a further alternative baffle having secondary baffles which snap into place.
Figure 20:
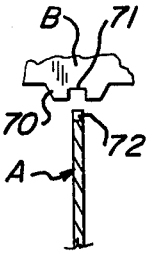
FIG. 20 is a fragmentary, exploded view which indicates the manner in which the secondary baffles snap into place on the primary baffle of FIG. 18.
Figure 19:
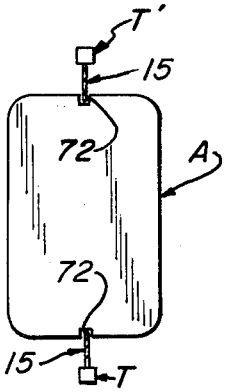
FIG. 19 is a vertical section taken along line 19—19 of FIG. 18.

In the alternative construction shown in FIGS. 18–20, secondary or auxiliary baffles A are separately formed to simulate the secondary baffles S of FIGS. 2 and 3. Auxiliary baffles A may have the same exterior dimensions as baffles B, with the exception of the center stem at the top and bottom. Also, the cutouts 18 will correspond to the cutouts 18 of FIGS. 1 and 3, but at the center an angularly sided nib 70, provided with a notch 71 at the center, extends downwardly at the top and upwardly at the bottom. Each auxiliary baffle A is provided, at the center, with a notch 72 which extends downwardly at the top and upwardly at the bottom. A portion of a baffle B, including a nib 70, is shown in FIG. 20, with a baffle A and its notch 72 spaced therefrom, but it will be evident that the upper end of baffle A may be moved upwardly until notch 72 intersects notch 71, with the opposite sides of notch 72 on opposite sides of nib 70, above notch 71, and the opposite sides of notch 71 on opposite sides of baffle A below notch 72. Baffles A may be made of any desired material, such as plastic or a different metal than baffle B, or the same metal but having a different color, as by painting or anodizing. Thus, there is an endless variety of different colors or combinations of different colors, for varying esthetic effects. Each auxiliary baffle A is preferably formed of a sufficiently flexible material that the lower end may be inserted in lower nib 70 by intersection of the lower notches, and then snapped into the upper notch 71. The slanting sides of nib 70 may be of assistance in the installation of a baffle A.

Figure 21:
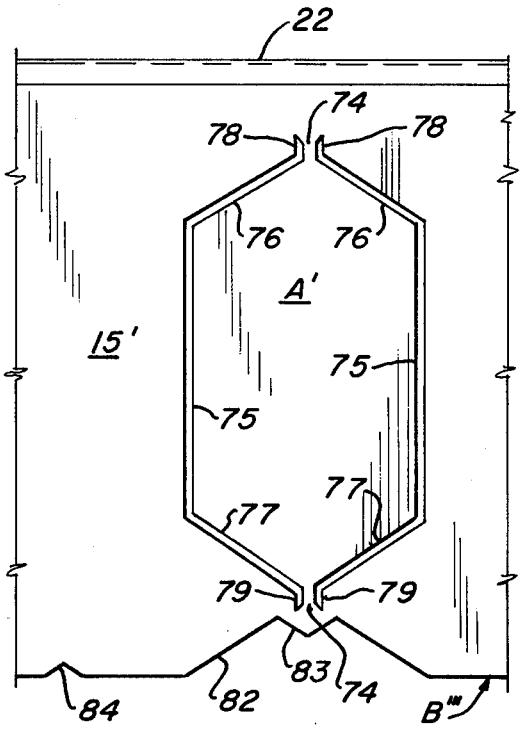
FIG. 21 is a side elevation of a portion of a further alternative baffle, showing the slots for a secondary baffle.
Figure 22:
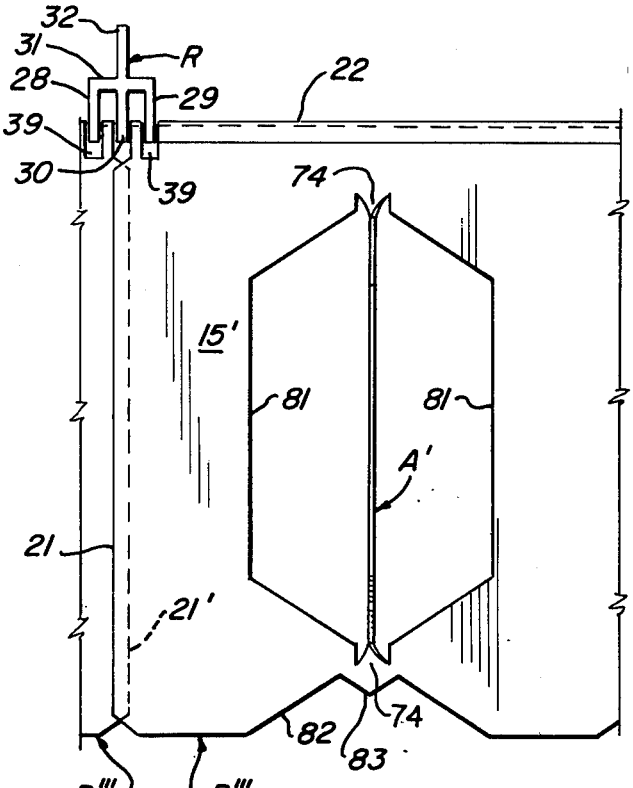
FIG. 22 is a side elevation of a portion of the baffle of FIG. 21, showing the secondary baffle moved into position and a portion of an abutting baffle and the support therefor.
Figure 23:
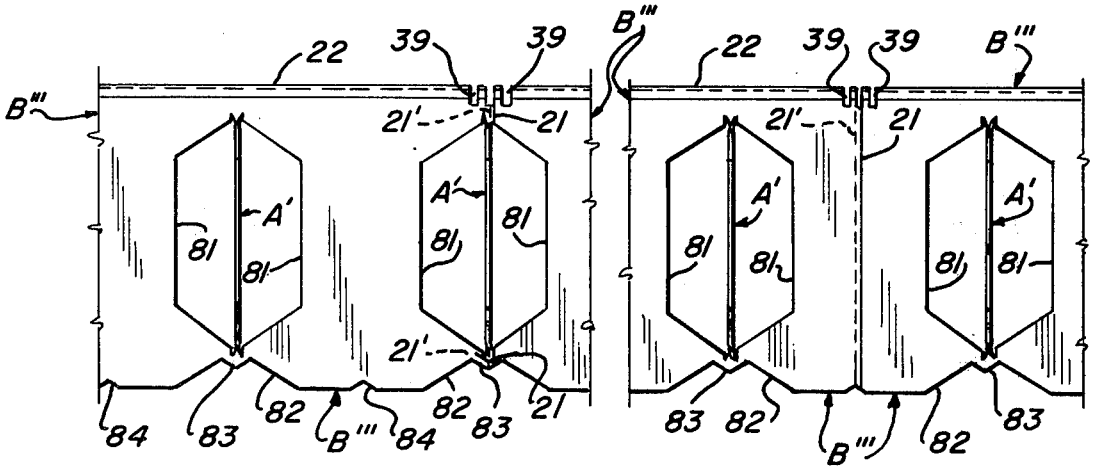
FIG. 23 is a condensed side elevation, on a reduced scale, showing differing joints between abutting baffles of FIG. 22.

The alternative construction illustrated in FIGS. 21–23 may include hexagonal auxiliary baffles A′ attached at their upper and lower centers to the corresponding baffle B‴ by twisted stems 74. The outline of each baffle A is produced by forming, in web 15′, upright side slots 75 and connecting inwardly angling upper slots 76 and angling lower slots 77. Also, connected parallel slots 79 extend upwardly at the top and downwardly, at the bottom, to produce a stem 74 between them. When the auxiliary baffle A′ is turned to the position of FIG. 22, each stem 74 will be twisted a corresponding amount. The hexagonal baffles A′ permit, along with other modifications, a variety of constructions from which to choose for a desired utilitarian or esthetic objective. The lower edge of baffle B‴ may be linear or have some other shape, such as a larger notch 82 provided with a triangular nib 83 at the center and opposite the respective auxiliary baffle A′. A series of smaller notches 84 may be interspaced midway between notches 82. A series of baffles B‴ may be supported by appropriate rails R and reinforced at alternate end edges by overlapping abutting, angular tongues 21 and 21′, as in FIGS. 22 and 23. At the other alternate end edges, as in FIG. 23, an auxiliary baffle A′ may be spaced from the edge a distance corresponding to tongue 21 and one half the width of the stem 74, with tongue 21 occupying the remainder of the upright edge. The abutting baffle B‴ may be provided with a single cutout 81, with the remainder of the edge being occupied by tongue 21′, as in FIG. 23. When the baffles B‴ are provided with a tongue 21 at one end and a cutout 81 at the opposite end, the above described joints will alternate along a series of such baffles.

Although a number of embodiments of this invention have been illustrated and described and certain variations therein also described, it will be understood that other embodiments may exist and various changes may be made, without departing from the spiritand scope of this invention.

What is claimed is:

1. An illuminator grid for disposition below one or more light sources and for intercepting light rays directed downwardly but at angle less than a predetermined angle to the horizontal from said light sources, comprising:

a series of coplanar, upright primary baffles disposed in spaced, parallel relation;

a series of upright, longitudinally spaced secondary baffles, each extending laterally to each side of the corresponding primary baffle and interspaced in position with the secondary baffles of the adjacent primary baffle;

said primary baffles having separated apertures corresponding to the shape of said secondary baffles and through which said secondary baffles extend;

said primary baffles being spaced apart a distance such that the upright edges of said secondary baffles of one primary baffle extend to or past the upright edges of said secondary baffles of an adjacent primary baffle, in the direction of said secondary baffles; and means connecting the top and bottom of each said secondary baffle with the corresponding primary baffle.

2. An illuminator grid as defined in claim 1, wherein: twisted stems connect said secondary baffles with the corresponding primary baffle.

3. An illuminator grid as defined in claim 1, wherein: angular stems connect said secondary baffles with the corresponding primary baffle.

4. An illuminator grid as defined in claim 1, wherein: said secondary baffles are perpendicular to said primary baffles.

5. An illuminator grid as defined in claim 4, wherein: each said secondary baffle extends the same distance to each side of the corresponding primary baffle and said primary baffles are spaced equidistantly apart.

6. An illuminator grid as defined in claim 1, wherein: said secondary baffles are disposed in vertically spaced rows extending longitudinally of said primary baffle, with the secondary baffles of one row being interspaced with the secondary baffles of other rows.

7. An illuminator grid as defined in claim 1, wherein: a row of secondary baffles extends longitudinally of the corresponding primary baffle and are spaced a greater distance from the upper edge of said primary baffle than from the lower edge of said primary baffle.

8. An illuminator grid as defined in claim 1, wherein: said primary baffles are provided with an angular upper edge.

9. An illuminator grid as defined in claim 1 and a series of spaced, parallel rails extending transversely to said primary baffles for supporting the ends of said primary baffles, wherein:

said rails are provided with a depending portion provided with a reentrant slot; and said primary baffles are provided with notches at the upper edge adjacent the ends for engaging the corresponding reentrant slots of said rails.

10. An illuminator grid as defined in claim 9, wherein:

said reentrant slots of said rails extend upwardly from the lower edge of said depending portion of said rail, then longitudinally and downwardly to a flat ledge, then upwardly in generally the shape of a thumb and downwardly to the lower edge of said depending portion at a point spaced from the opposite edge of said reentrant slot;

the upper edges of said primary baffles are provided with an angular flange connected to a horizontal flange;

a first transverse slot in said horizontal flange flanks said depending portion adjacent said flat but opposite said thumb;

a second slot opposite said first slot extends through a portion of said angular flange and an adjacent portion of said first baffle a distance to leave a flat of said horizontal flange between said slots; and said flat portion of said horizontal flange is adapted to rest on said flat of said reentrant slot, with said depending portion below said flat extending through said second slot.

11. An illuminator grid as defined in claim 1, including:

a tubular reinforcing member for the lower edge of each said primary baffle and having a longitudinal slot in the top for extension of the lower edge of said primary baffle into the hollow inside of said tubular member; and an angular configuration at the lower edge of said primary baffle for retaining said tubular member on said primary baffle.

12. An illuminator grid as defined in claim 1, wherein:

said secondary baffles are generally pentagonal in shape.

13. An illuminator grid as defined in claim 1, wherein:

said secondary baffles are generally hexagonal in shape.

14. An illuminator grid as defined in claim 1, wherein:

the lower edge of each said primary baffle is provided with spaced notches.

15. An illuminator grid as defined in claim 14, wherein:

said notches correspond in position to said secondary baffles.

16. An illuminator grid, comprising:

a series of upright primary baffles extending in a longitudinal direction in spaced, parallel relation;

a series of secondary baffles extending through apertures in each said primary baffle to each side of the corresponding primary baffle; and means connecting each said secondary baffle with the corresponding primary baffle including slots at an upper and lower position of said secondary baffles and nibs formed in the corresponding apertures in said primary baffles for engaging said slots.

17. An illuminator grid as defined in claim 16, wherein:

said secondary baffles correspond in shape to said apertures in said primary baffles.

* * * * *